US011390998B2

(12) United States Patent
Karasaki et al.

(10) Patent No.: US 11,390,998 B2
(45) Date of Patent: Jul. 19, 2022

(54) FLAME RETARDANT PAPER

(71) Applicant: Toray Industries, Inc., Tokyo (JP)

(72) Inventors: Hideaki Karasaki, Otsu (JP); Tomoko Takano, Otsu (JP); Kazuya Nishioka, Otsu (JP)

(73) Assignee: Toray Industries, Inc., Tokyo (JP)

( * ) Notice: Subject to any disclaimer, the term of this patent is extended or adjusted under 35 U.S.C. 154(b) by 122 days.

(21) Appl. No.: 16/970,997

(22) PCT Filed: Feb. 25, 2019

(86) PCT No.: PCT/JP2019/006977
§ 371 (c)(1),
(2) Date: Aug. 19, 2020

(87) PCT Pub. No.: WO2019/167860
PCT Pub. Date: Sep. 6, 2019

(65) Prior Publication Data

US 2020/0399833 A1 Dec. 24, 2020

(30) Foreign Application Priority Data

Mar. 2, 2018 (JP) ..... JP2018-037125

(51) Int. Cl.

| | |
|---|---|
| ***D21H 21/34*** | (2006.01) |
| ***D21H 17/67*** | (2006.01) |
| ***D21H 21/14*** | (2006.01) |

(52) U.S. Cl.
CPC ..... *D21H 21/34* (2013.01); *D21H 5/0002* (2013.01); *D21H 17/675* (2013.01); *D21H 21/143* (2013.01)

(58) Field of Classification Search
CPC .... D21H 17/63; D21H 17/675; D21H 5/0002; D21H 17/10; D21H 17/09; D21H 17/66; D21H 21/34; D21H 21/143; D21H 17/07
USPC ..... 162/159
See application file for complete search history.

(56) References Cited

U.S. PATENT DOCUMENTS

2016/0208438 A1 7/2016 Sugahara et al.

FOREIGN PATENT DOCUMENTS

| | | | |
|---|---|---|---|
| JP | 57-171799 | A | 10/1982 |
| JP | 11-108409 | A | 4/1999 |
| JP | 2000-8299 | A | 1/2000 |
| JP | 2004-36042 | A | 2/2004 |
| JP | 2013-2003 | A | 1/2013 |
| WO | 2014/088019 | A1 | 6/2014 |
| WO | 2017/002863 | A1 | 1/2017 |

*Primary Examiner* — Mark Halpern
(74) *Attorney, Agent, or Firm* — DLA Piper LLP (US)

(57) ABSTRACT

A flame retardant paper includes pulp, aluminum hydroxide, guanidine phosphate and guanidine sulfamate, wherein the content of the pulp is 10 to 35% by mass and the content of the aluminum hydroxide is 40 to 70% by mass, and the total content of the guanidine phosphate and the guanidine sulfamate is 0.1 to 10% by mass based on the contents of the flame retardant paper.

4 Claims, No Drawings

FLAME RETARDANT PAPER

This application is a 371 of PCT/JP2019/006977 filed 25 Feb. 2019.

TECHNICAL FIELD

This disclosure relates to a flame retardant paper.

BACKGROUND

Development of flame retardant paper has been conventionally demanded in many fields. For example, paper is widely used in electric/electronic materials, industrial materials and the like, and in some of these fields, there is an increasing demand for development of flame retardant paper.

Known methods of imparting flame retardancy to paper include coating or impregnating with a flame retardant agent, internally adding a flame retardant organic substance or inorganic powder, mixing with an inorganic fiber to make paper, a combination thereof and the like. More specifically, for example, a flame retardant paper containing flame retardant fibers and aluminum hydroxide has been proposed (see WO 2014/088019).

Furthermore, flame retardant paper for a member of a radio wave absorber used in an anechoic chamber or the like is used for 10 years or more. It is desired that the reduction in the flame retardancy during this period is suppressed.

To solve the above-mentioned demands, a flame retardant paper for a member of a radio wave absorber, containing pulp and a flame retardant agent composed of aluminum hydroxide and polyborate, has been proposed (see WO 2017/002863).

The flame retardant paper and the flame retardant paper for a member of a radio wave absorber proposed in WO '019 and WO '863 are fragile and torn, for example, upon drying in a process of providing reagent by way of impregnation, coating or the like as well as during secondary processing such as slitting or printing. This results in a processing problem of significantly reduced productivity. In addition, when the flame retardant paper is corrosive to metal used in the equipment for production, the flame retardant paper tends to corrode the metal part of the equipment for production which is in direct contact with the flame retardant paper, which causes a problem of deterioration of the equipment for production.

Therefore, it could be helpful to provide a flame retardant paper that is less likely to be torn upon drying in a process of providing reagent by way of impregnation, coating or the like as well as during secondary processing such as slitting or printing and that has low corrosiveness to metal of the equipment for production, in addition to high flame retardancy which is suitable for a member of a radio wave absorber.

SUMMARY

We thus provide:

(1) A flame retardant paper comprising pulp, aluminum hydroxide, guanidine phosphate and guanidine sulfamate, wherein the content of the pulp is 10 to 35% by mass, the content of the aluminum hydroxide is 40 to 70% by mass, and the total content of the guanidine phosphate and the guanidine sulfamate is 0.1 to 10% by mass, given that each of the contents is with respect to the entirety of the flame retardant paper.

(2) The flame retardant paper according to (1), wherein the content of the pulp is 20 to 35% by mass and the total content of the guanidine phosphate and the guanidine sulfamate is 0.3 to 9% by mass.

(3) The flame retardant paper according to (1) or (2), wherein the mass ratio of guanidine sulfamate to guanidine phosphate (guanidine sulfamate/guanidine phosphate) contained in the flame retardant paper is 5/95 or more and 30/70 or less.

(4) The flame retardant paper according to any one of (1) to (3), further comprising a conductive sub stance.

(5) A radio wave absorbing sheet in which the flame retardant paper according to (4) is used.

A flame retardant paper that is less likely to be torn upon drying in a process of providing reagent by way of impregnation, coating or the like as well as during secondary processing such as slitting or printing and that has low corrosiveness to metal of the equipment for production in addition to high flame retardancy can be obtained.

DETAILED DESCRIPTION

Our flame retardant paper is described below by way of examples.

The flame retardant paper is a flame retardant paper comprising pulp, aluminum hydroxide, guanidine phosphate and guanidine sulfamate, wherein the content of the pulp is 10 to 35% by mass, the content of the aluminum hydroxide is 40 to 70% by mass, and the total content of the guanidine phosphate and the guanidine sulfamate is 0.1 to 10% by mass, given that each of the contents is with respect to the entirety of the flame retardant paper.

Examples of the pulp used in the flame retardant paper include pulp made of plant fibers such as softwood pulp, hardwood pulp, thermomechanical pulp, groundwood pulp, linter pulp or hemp pulp, pulp made of recycled fibers such as rayon, and synthetic fiber pulp made of vinylon, polyester, or the like. One of these pulps or two or more of these pulps can be appropriately selected and used.

The flame retardant paper contains 10 to 35% by mass of pulp with respect to the entirety of the flame retardant paper. When the pulp content is less than 10% by mass, the entanglement force of the pulp in the papermaking process is weak, resulting in difficult formation of a sheet shape. In addition, the content of the pulp is preferably 17% by mass or more, and more preferably 20% by mass or more because formation of the sheet shape in the papermaking process is easier and, furthermore, tearing of the flame retardant paper or the like is suppressed upon drying in a process of providing reagent that imparts flame retardancy by way of impregnation, coating or the like (also referred to as process of providing reagent) as well as during secondary processing such as slitting or printing.

On the other hand, when the content of the pulp exceeds 35% by mass, flame retardancy which is sufficient as a flame retardant paper may not be obtained.

Thus, when the content of the pulp is 10 to 35% by mass, it is possible to obtain a sheet of flame retardant paper having excellent flame retardancy.

The flame retardant paper contains 40 to 70% by mass of aluminum hydroxide. Aluminum hydroxide is preferably supported uniformly on the flame retardant paper. In addition, the aluminum hydroxide is preferably powder.

The aluminum hydroxide is dehydrated and decomposed at a high temperature, and the resulting endothermic action provides an effect of flame retardancy. This flame retardancy does not deteriorate over time even after long-term storage and the effect of flame retardancy is maintained.

Further, by appropriately adding a papermaking reagent such as a retention agent or a paper-strengthening agent made of a cationic polymer compound or an anionic polymer compound during the papermaking of flame retardant paper, aluminum hydroxide is adsorbed on the pulp, which contributes to the improved flame retardancy of the flame retardant paper.

Further, since aluminum hydroxide is a white powder, when the flame retardant paper is used in a radio wave absorber for an anechoic chamber, for example, the indoor lighting effect can be enhanced. Furthermore, aluminum hydroxide does not discolor and can keep the flame retardant paper white.

When the content of the aluminum hydroxide is less than 40% by mass, the flame retardant paper may not have sufficient flame retardancy. Furthermore, when used as a flame retardant paper for a member of a radio wave absorber, since the pulp content in the flame retardant paper is increased, discoloration over time becomes noticeable.

On the other hand, when the content of the aluminum hydroxide exceeds 70% by mass, high flame retardancy of the flame retardant paper can be obtained, but the entanglement force of the pulp in the papermaking process is weak, resulting in difficult formation of a sheet shape.

Thus, when the content of the aluminum hydroxide is 40 to 70% by mass, it is possible to obtain a sheet of flame retardant paper having excellent flame retardancy and retaining whiteness. Aluminum hydroxide can be purchased from Wako Pure Chemical Corporation, Sigma-Aldrich Japan, and the like.

Further, the flame retardant paper contains 0.1 to 10% by mass in total of guanidine phosphate and guanidine sulfamate.

Generally, the higher the content of the reagent that imparts flame retardancy is, the higher the flame retardancy of the flame retardant paper is. However, a large content of the reagent that imparts flame retardancy tends to cause tearing of the flame retardant paper or the like upon drying in a process of providing reagent that imparts flame retardancy by way of impregnation, coating or the like (hereinafter, also referred to as process of providing reagent) as well as during secondary processing such as slitting or printing. It is believed that this is because the large content of the reagent that imparts flame retardancy results in decreased toughness of the flame retardant paper. When guanidine phosphate and guanidine sulfamate are used in combination, the required amount for improving the flame retardancy of the flame retardant paper containing a certain amount or more of pulp can be reduced compared to the required amount of a polyborate or the like. Therefore, it is possible to impart high flame retardancy to the flame retardant paper as well as to maintain the toughness of the flame retardant paper which is suitable for drying in the process of providing reagent by way of impregnation, coating or the like as well as for secondary processing such as slitting and printing. Further, guanidine sulfamate exhibits hygroscopicity and therefore can impart flexibility to the flame retardant paper due to the water content. Thus, the handling property of the flame retardant paper can be improved.

When the total content of the guanidine phosphate and the guanidine sulfamate with respect to the entirety of the flame retardant paper is 0.1% or less, the flame retardancy of the flame retardant paper tends to be insufficient. For the above reason, the total content of the guanidine phosphate and the guanidine sulfamate with respect to the entirety of the flame retardant paper is preferably 0.3% by mass or more.

On the other hand, when the total content of the guanidine phosphate and the guanidine sulfamate with respect to the entirety of the flame retardant paper is 10% or more, a flame retardant paper can be torn or the like upon drying in a process of providing reagent by way of impregnation, coating or the like as well as during secondary processing such as slitting or printing, leading to deterioration of the handling property and passage of processes. Further, in a member stuck on another molded body such as foamed plastic or the like, sufficient flame retardancy may not be obtained. For the above reason, the total content of the guanidine phosphate and the guanidine sulfamate with respect to the entirety of the flame retardant paper is preferably 9% by mass or less.

The mass ratio of the guanidine sulfamate to the guanidine phosphate (guanidine sulfamate/guanidine phosphate) in the flame retardant agent is preferably 5/95 or more and 30/70 or less.

When the mass ratio of the guanidine sulfamate to the guanidine phosphate (guanidine sulfamate/guanidine phosphate) is 5/95 or more, tearing of the flame retardant paper or the like can be suppressed upon drying in a process of providing reagent by way of impregnation, coating or the like as well as during secondary processing such as slitting or printing.

On the other hand, when the mass ratio of the guanidine sulfamate to the guanidine phosphate (guanidine sulfamate/guanidine phosphate) is 30/70 or less, the corrosiveness to metal of the equipment for production can be suppressed.

The flame retardant paper may contain an inorganic fiber such as a glass fiber, mineral wool or a basalt fiber. Since these are inorganic fibers, they can improve the flame retardancy of the flame retardant paper. Furthermore, since these rigid fibers can exhibit a high degree of rigidity in the flame retardant paper, the handling property of the flame retardant paper can be improved. The content of the inorganic fiber is preferably 1 to 30% by mass when the entire flame retardant paper is considered as 100% by mass. The content of the inorganic fibers is more preferably 15% by mass or less. Within this range, flame retardant paper having a high degree of rigidity can be stably manufactured.

The flame retardant paper can contain a conductive substance. The conductive substance is, when the flame retardant paper is used as a flame retardant paper for a member of a radio wave absorber, a material that converts radio wave energy into a minute electric current and further converts into heat energy to attenuate the radio wave, that is, to absorb radio waves. Examples of the conductive substance include conductive particles and conductive fibers. Examples of the conductive particles herein include metal particles, carbon black particles, carbon nanotube particles, carbon microcoil particles, graphite particles and the like. Examples of the conductive fibers include carbon fibers, metal fibers and the like, and examples of the metal fibers include stainless fibers, copper fibers, silver fibers, gold fibers, nickel fibers, aluminum fibers, iron fibers and the like. Furthermore, the conductive substance can also include non-conductive particles and fibers to which conductivity is imparted by plating, vapor deposition, thermal spraying or the like with metal.

Among these conductive substances, conductive fibers are preferably used, and among the conductive fibers, conductive short fibers are preferably used. Since the conductive short fibers have a large aspect ratio, the fibers are likely to come into contact with each other. Therefore, compared to the powder, the performance of radio wave absorption can be effectively obtained even in a small amount. Further, among the conductive short fibers, carbon fibers are particularly preferably used because the fibers are rigid and easily oriented in the substrate, and show almost no change in the performance during the long-term use. The length of the conductive short fibers is preferably 0.1 mm or more, and more preferably 1.0 mm or more from the viewpoint of the easy contact between the fibers and the dispersibility of the slurry in the papermaking process, which will be described later. On the other hand, the length of the conductive short fibers is preferably 15.0 mm or less, and more preferably 10.0 mm or less.

In the flame retardant paper, the content of the conductive substance is preferably 0.05 parts by mass or more and 5 parts by mass or less with respect to 100 parts by mass of the raw material of the flame retardant paper excluding the conductive substance. Further, the content thereof is preferably 0.1 parts by mass or more, and more preferably 0.3 parts by mass or more. On the other hand, the content thereof is preferably 4 parts by mass or less, and more preferably 3 parts by mass or less.

The flame retardant paper preferably has a basis weight of 50 to 200 g/m$^2$. When the basis weight is in this range, the toughness of the flame retardant paper is improved, which can prevent the flame retardant paper from being torn or the like upon drying in a process of providing reagent to the flame retardant paper by way of impregnation, coating, or the like as well as during secondary processing such as slitting or printing. The basis weight is preferably 80 g/m$^2$ or more. On the other hand, the basis weight is preferably 150 g/m$^2$ or less.

The method of producing the flame retardant paper will be described below.

As an example of the method of producing the flame retardant paper, the following papermaking method with paper materials can be used. A wet papermaking method can be used, in which a slurry is prepared by mixing constituent materials of the flame retardant paper, which are fibers (pulp), aluminum hydroxide and the like, with water, and then made into paper with a paper machine.

Examples of the paper machine include a cylinder wire, a short-fourdrinier wire, a Fourdrinier wire, Birch former, Roto former, hydroformer, and the like. Any paper machine can be used. Examples of dryers include Yankee type dryers, multi-cylinder type dryers, through-type dryers and the like. Any dryer can be used.

The method of incorporating guanidine phosphate and guanidine sulfamate into the flame retardant paper is not particularly limited. Examples thereof include application by impregnation, by coating and the like. For the application by impregnation or by coating, a coating device such as a size press coater, a roll coater, a blade coater, a bar coater or an air knife coater can be used, and these devices can be used on-machine or off-machine.

Examples of the method of adding conductive fibers to the flame retardant paper include a method in which the conductive fibers are mixed into the slurry described above and incorporated into the flame retardant paper, a method in which the conductive fibers are mixed into a binder resin material and coated on the flame retardant paper using a device such as a size press coater, a roll coater, a blade coater, a bar coater, or an air knife coater and the like.

EXAMPLES

The flame retardant paper will be further described in detail in the following Examples. The values in performance shown in Examples are measured by the following methods.

Measurement Methods (1) Identification of Guanidine Phosphate and Guanidine Sulfamate A 200 mm×200 mm test piece of flame retardant paper is immersed for 10 minutes in 500 mL of hot water at 100° C. filled in a 1 L container. The test piece is then taken out from the hot water and washed with 50 mL of water at room temperature for 5 minutes. Then, 50 mL of the remaining hot water and 50 mL of the water at room temperature after the test piece was taken out were put into a 300 mL container and dried at 80° C. for 12 hours. The precipitated solid was photographed by an ultrahigh resolution field emission type scanning electron microscopy (SEM, SU-8010 model manufactured by Hitachi High-Tech Corporation) at five (5) areas in total which were selected at random in the solid, and the presence of specific elements was confirmed by an energy dispersive X-ray analyzer (EDX). Furthermore, together with the results obtained by measuring the above solid with an infrared spectrophotometer (FT-IR, IR PRESTIGE-21 manufactured by Shimadzu Corporation), the presence or absence of guanidine phosphate and guanidine sulfamate in the flame retardant paper as well as the content of each of guanidine phosphate and guanidine sulfamate are determined.

(2) Identification of Other Components than Guanidine Phosphate and Guanidine Sulfamate The test piece of the above-mentioned flame retardant paper washed in (1) is dried at 150° C. for 10 minutes. Using an ultrahigh resolution field emission type scanning electron microscopy (SEM, SU-8010 model manufactured by Hitachi High-Tech Corporation), five (5) areas in total of the dried test piece, including four (4) area points around points shifted by 5 cm in the vertical and horizontal directions from the four (4) corners of the test piece towards the center of the test piece and one area around a point at the center of the test piece, are photographed. The presence of specific elements is confirmed by an energy dispersive X-ray analyzer (EDX), and together with the measurement results of the above test piece obtained with an infrared spectrophotometer (FT-IR, IR PRESTIGE-21 manufactured by Shimadzu Corporation) and the results obtained in (1), the presence or absence of other components than guanidine phosphate and guanidine sulfamate in the flame retardant paper as well as the content of other components than guanidine phosphate and guanidine sulfamate are determined.

(3) Basis Weight of Flame Retardant Paper

Five sheets of flame retardant paper are cut into squares each having a side of 300 mm to measure the mass which is converted to the mass per 1 m$^2$, and the average value is taken to calculate the basis weight.

(4) Flame Retardancy of Flame Retardant Paper

Evaluation is based on 20-mm Vertical Combustion Test (UL94 V-0) in the UL94 Safety Standards ("Tests for Flammability of Plastic Materials for Parts in Devices and Appliances"). UL herein is safety standards for accepted electronic products which is established by Underwriters Laboratories Inc., the United States. UL94 is the standard for flame retardancy as well.

Pass: For the standard of all the five, the time for burning of the distance of 100 mm (from the line at 25 mm to the line at 125 mm) is measured, and the burning rate is calculated, and there should be no sample burning at a burning rate exceeding 40 mm/min. Alternatively, it has to be a sample with its fire extinguished before the combustion or the fire reaches the line at 125 mm.

Fail: At least one of the five does not meet the above pass criteria.

(5) Flame Retardancy of a Member Obtained by Sticking Flame Retardant Paper and Expanded Polystyrene A flame retardant paper and a 10-mm thick expanded polystyrene are stuck each other with a double-sided tape (recycled paper double-sided tape NWBB-15, manufactured by NICHIBAN CO., LTD.) to prepare a member in which the flame retardant paper and the expanded polystyrene are joined.

The above-described member is evaluated for the burning rate in accordance with Horizontal Burning Foamed Material Test (UL94 HBF) in the UL94 Safety Standards ("Tests for Flammability of Plastic Materials for Parts in Devices and Appliances").

Pass: Among five samples having a dimension of 150 mm (length) and 50 mm (width), the time for burning of the length of 100 mm (from the line at 25 mm to the line at 125 mm) is measured, and the burning rate is calculated, and there should be no sample burning at a burning rate exceeding 40 mm/min. Alternatively, it has to be a sample with its fire extinguished before the combustion reaches the line at 125 mm.

Fail: At least one of the five does not meet the above pass criteria.

(6) Tearability

The presence or absence of tearing of the flame retardant paper was confirmed by the following method. The flame retardant paper cut into a 100-mm square is dried at 80° C. for 120 seconds, cooled at room temperature for 10 seconds, followed by repeated mountain folds and valley folds. The number of the folding times when a rip occurs at the crease is recorded (upper limit is 20 times). It can be considered that as the number of the folding times until a rip occurs increases, the flame retardant paper is less likely to be torn.

(7) Corrosiveness to Metal

The flame retardant paper is fixed with an iron clip, and after a high humidity treatment (temperature of 60° C., humidity of 90%, treatment duration of 1 week), the presence or absence of the corrosion of the clip is confirmed.

Evaluation Criteria

A: No corrosion is confirmed.

B: Corrosion is confirmed on part of the clip.

C: Corrosion is confirmed on the entire clip.

(8) Complex Permittivity

Using a rectangular waveguide (manufactured by Kanto Electronic Application and Development Inc.), the complex permittivity at 3.0 GHz was calculated using the S-parameter method. The S-parameter method is a method in which the reflection (S11) and transmission (S21) of a sample inserted in the middle of a transmission line are measured with a network analyzer (Agilent Technologies, Inc.) to obtain a complex permittivity. The real part of the complex permittivity was $\varepsilon^R$ and the imaginary part was $\varepsilon^J$.

The real part $\varepsilon^R$ of the complex permittivity is a term corresponding to a normal relative permittivity. When the real part $\varepsilon^R$ of the complex permittivity is too small, the radio wave cannot be efficiently attenuated because the compression of the wavelength of the radio waves taken into the absorbing material is small. Further, when the real part $\varepsilon^R$ of the complex permittivity is too large, radio waves tend to be reflected on the surface of the absorbing material.

The imaginary part $\varepsilon^J$ of the complex permittivity is a term due to the electrical loss, and this term allows for the conversion of radio wave energy into heat energy for the radio wave attenuation. When the imaginary part $\varepsilon^J$ of the complex permittivity is too small, the attenuation of radio waves in the absorbing material tends to be small while too a large imaginary part $\varepsilon^J$ of the complex permittivity indicates the tendency of the reflection on the surface of the absorbing material.

Evaluation Criteria

A: Both the real part $\varepsilon^R$ and the imaginary part $\varepsilon^J$ of the complex permittivity are 10 or more, and the performance of the radio wave absorption is exhibited.

B: Both the real part $\varepsilon^R$ and the imaginary part $\varepsilon^J$ of the complex permittivity are less than 10, and the performance of the radio wave absorption is not exhibited.

Example 1

First, 15% by mass of softwood pulp having a fiber length of 5 mm as pulp, 65% by mass of aluminum hydroxide (Wako Pure Chemical Corporation) and 15% by mass of glass fibers were mixed to perform wet papermaking in the continuous papermaking method. Thus, a flame retardant paper was obtained.

Using a size press coater, a flame retardant agent containing guanidine phosphate (product name "Nonnen" (registered trademark) 985, manufactured by Marubishi Oil Chemical Co., LTD.) and guanidine sulfamate (product name SG-2 (trade name), manufactured by Dainippon Ink and Chemicals, Inc.) was applied in an amount of 5% by mass with respect to the entirety of the flame retardant paper. Thus, a flame retardant paper having a basis weight of 108 g/m$^2$ was obtained. The mass ratio of the guanidine sulfamate to the guanidine phosphate (guanidine sulfamate/guanidine phosphate) was 10/90.

The resulting flame retardant paper was evaluated. The results are shown in Table 1. The burning rate of the flame retardant paper was slow and passed UL94 V-0. The burning rate of the member stuck on expanded polystyrene was also slow and passed UL94 HBF. In addition, the tearability was good, and the corrosiveness by the flame retardant paper to the metal was not observed, either. The performance of the radio wave absorption was not exhibited.

Example 2

A flame retardant paper having a basis weight of 108 g/m$^2$ of Example 2 was obtained in the same manner as in Example 1 except that the pulp and the aluminum hydroxide of Example 1 were 20% by mass and 60% by mass, respectively.

The resulting flame retardant paper was evaluated. The results are shown in Table 1. The burning rate of the flame retardant paper was slow, and passed UL94 V-0. The burning rate of the member stuck on expanded polystyrene was also slow, and passed UL94 HBF. In addition, the tearability was good, and the corrosiveness by the flame retardant paper to the metal was not observed, either. The performance of the radio wave absorption was not exhibited.

Example 3

A flame retardant paper having a basis weight of 108 g/m$^2$ of Example 3 was obtained in the same manner as in Example 1 except that the pulp and the aluminum hydroxide of Example 1 were 30% by mass and 50% by mass, respectively.

The resulting flame retardant paper was evaluated. The results are shown in Table 1. The burning rate of the flame retardant paper was slow and passed UL94 V-0. The burning rate of the member stuck on expanded polystyrene was also slow and passed UL94 HBF. In addition, the tearability was good, and the corrosiveness by the flame retardant paper to the metal was not observed, either. The performance of the radio wave absorption was not exhibited.

Example 4

A flame retardant paper having a basis weight of 104 g/m$^2$ of Example 4 was obtained in the same manner as in Example 2 except that the aluminum hydroxide and the flame retardant agent of Example 2 were 64.5% by mass and 0.5% by mass, respectively.

The resulting flame retardant paper was evaluated. The results are shown in Table 1. The burning rate of the flame retardant paper was slow and passed UL94 V-0. The burning rate of the member stuck on expanded polystyrene was also slow and passed UL94 HBF. In addition, the tearability was good, and the corrosiveness by the flame retardant paper to the metal was not observed, either. The performance of the radio wave absorption was not exhibited.

Example 5

A flame retardant paper having a basis weight of 108 g/m$^2$ of Example 5 was obtained in the same manner as in Example 2 except that the pulp, the aluminum hydroxide, and the glass fibers of Example 2 were 19% by mass, 62% by mass, and 14% by mass, respectively.

The resulting flame retardant paper was evaluated. The results are shown in Table 1. The burning rate of the flame retardant paper was slow and passed UL94 V-0. The burning rate of the member stuck on expanded polystyrene was also slow and passed UL94 HBF. In addition, the tearability was good, and the corrosiveness by the flame retardant paper to the metal was not observed, either. The performance of the radio wave absorption was not exhibited.

Example 6

A flame retardant paper having a basis weight of 114 g/m$^2$ of Example 6 was obtained in the same manner as in Example 2 except that the pulp, the aluminum hydroxide, the glass fibers, and the flame retardant agent of Example 2 were 18% by mass, 59% by mass, 13% by mass, and 10% by mass, respectively.

The resulting flame retardant paper was evaluated. The results are shown in Table 1. The burning rate of the flame retardant paper was slow and passed UL94 V-0. The burning rate of the member stuck on expanded polystyrene was also slow and passed UL94 HBF. In addition, the tearability was good, and the corrosiveness by the flame retardant paper to the metal was not observed, either. The performance of the radio wave absorption was not exhibited.

Example 7

A flame retardant paper having a basis weight of 108 g/m$^2$ of Example 7 was obtained in the same manner as in Example 2 except the mass ratio of the guanidine sulfamate to the guanidine phosphate (guanidine sulfamate/guanidine phosphate) of Example 2 was changed to 15/85.

The resulting flame retardant paper was evaluated. The results are shown in Table 1. The burning rate of the flame retardant paper was slow and passed UL94 V-0. The burning rate of the member stuck on expanded polystyrene was also slow and passed UL94 HBF. In addition, the tearability was good, and the corrosiveness by the flame retardant paper to the metal was not observed, either. The performance of the radio wave absorption was not exhibited.

Example 8

A flame retardant paper having a basis weight of 108 g/m$^2$ of Example 8 was obtained in the same manner as in Example 2 except the mass ratio of the guanidine sulfamate to the guanidine phosphate (guanidine sulfamate/guanidine phosphate) of Example 2 was changed to 20/80.

The resulting flame retardant paper was evaluated. The results are shown in Table 1. The burning rate of the flame retardant paper was slow and passed UL94 V-0. The burning rate of the member stuck on expanded polystyrene was also slow and passed UL94 HBF. In addition, the tearability was good, and the corrosiveness by the flame retardant paper to the metal was not observed, either. The performance of the radio wave absorption was not exhibited.

Example 9

A flame retardant paper having a basis weight of 108 g/m$^2$ of Example 9 was obtained in the same manner as in Example 2 except the mass ratio of the guanidine sulfamate to the guanidine phosphate (guanidine sulfamate/guanidine phosphate) of Example 2 was changed to 25/75.

The resulting flame retardant paper was evaluated. The results are shown in Table 2. The burning rate of the flame retardant paper was slow and passed UL94 V-0. The burning rate of the member stuck on expanded polystyrene was also slow and passed UL94 HBF. In addition, the tearability was good, and the corrosiveness by the flame retardant paper to the metal was not observed, either. The performance of the radio wave absorption was not exhibited.

Example 10

A flame retardant paper having a basis weight of 108 g/m$^2$ of Example 10 was obtained in the same manner as in Example 2 except the mass ratio of the guanidine sulfamate to the guanidine phosphate (guanidine sulfamate/guanidine phosphate) of Example 2 was changed to 50/50.

The resulting flame retardant paper was evaluated. The results are shown in Table 2. The burning rate of the flame retardant paper was slow and passed UL94 V-0. The burning rate of the member stuck on expanded polystyrene was also slow and passed UL94 HBF. In addition, the tearability was good. However, some corrosion was observed on part of the clip. The performance of the radio wave absorption was not exhibited.

Example 11

A flame retardant paper having a basis weight of 108 g/m$^2$ of Example 11 was obtained in the same manner as in Example 2 except that the aluminum hydroxide and the carbon fibers of Example 2 were 59.5% by mass and 0.5% by mass, respectively.

The resulting flame retardant paper was evaluated. The results are shown in Table 2. The burning rate of the flame retardant paper was slow and passed UL94 V-0. The burning rate of the member stuck on expanded polystyrene was also slow and passed UL94 HBF. In addition, the tearability was good, and the corrosiveness by the flame retardant paper to the metal was not observed, either. The performance of the radio wave absorption was exhibited.

Example 12

A flame retardant paper having a basis weight of 108 g/m$^2$ of Example 12 was obtained in the same manner as in Example 2 except that the aluminum hydroxide and the carbon fibers of Example 2 were 59% by mass and 1.0% by mass, respectively.

The resulting flame retardant paper was evaluated. The results are shown in Table 2. The burning rate of the flame retardant paper was slow and passed UL94 V-0. The burning rate of the member stuck on expanded polystyrene was also slow and passed UL94 HBF. In addition, the tearability was good, and the corrosiveness by the flame retardant paper to the metal was not observed, either. The performance of the radio wave absorption was exhibited.

Example 13

A flame retardant paper having a basis weight of 108 g/m$^2$ of Example 13 was obtained in the same manner as in Example 12 except that the pulp and the carbon fibers of Example 12 were 19% by mass and 2.0% by mass, respectively.

The resulting flame retardant paper was evaluated. The results are shown in Table 2. The burning rate of the flame retardant paper was slow and passed UL94 V-0. The burning rate of the member stuck on expanded polystyrene was also slow and passed UL94 HBF. In addition, the tearability was good, and the corrosiveness by the flame retardant paper to the metal was not observed, either. The performance of the radio wave absorption was exhibited.

Example 14

A flame retardant paper having a basis weight of 108 g/m$^2$ of Example 14 was obtained in the same manner as in Example 13 except that the aluminum hydroxide, the glass fibers and the carbon fibers of Example 12 were 58% by mass, 14% by mass and 4.0% by mass, respectively.

The resulting flame retardant paper was evaluated. The results are shown in Table 2. The burning rate of the flame retardant paper was slow and passed UL94 V-0. The burning rate of the member stuck on expanded polystyrene was also slow and passed UL94 HBF. In addition, the tearability was good, and the corrosiveness by the flame retardant paper to the metal was not observed, either. The performance of the radio wave absorption was exhibited.

Example 15

A flame retardant paper having a basis weight of 108 g/m$^2$ of Example 15 was obtained in the same manner as in Example 14 except that the pulp, the aluminum hydroxide and the carbon fibers of Example 14 were 18% by mass, 57% by mass, and 6.0% by mass, respectively.

The resulting flame retardant paper was evaluated. The results are shown in Table 2. The burning rate of the flame retardant paper was slow and passed UL94 V-0. The burning rate of the member stuck on expanded polystyrene was also slow and passed UL94 HBF. In addition, the tearability was good, and the corrosiveness by the flame retardant paper to the metal was not observed, either. The performance of the radio wave absorption was exhibited.

TABLE 1

| | | Unit | Example 1 | Example 2 | Example 3 | Example 4 | Example 5 | Example 6 | Example 7 | Example 8 |
|---|---|---|---|---|---|---|---|---|---|---|
| Treatment | Pulp | % by mass | 15 | 20 | 30 | 20 | 19 | 18 | 20 | 20 |
| | Aluminum hydroxide | % by mass | 65 | 60 | 50 | 64.5 | 62 | 59 | 60 | 60 |
| | Glass fibers | % by mass | 15 | 15 | 15 | 15 | 14 | 13 | 15 | 15 |
| | Flame retardant agent | % by mass | 5 | 5 | 5 | 0.5 | 5 | 10 | 5 | 5 |
| | Guanidine phosphate (content) | % by mass | 4.5 | 4.5 | 4.5 | 0.45 | 4.5 | 9.0 | 4.25 | 4.0 |
| | Guanidine sulfamate (content) | % by mass | 0.5 | 0.5 | 0.5 | 0.05 | 0.5 | 1.0 | 0.75 | 1.0 |
| | Polyborate (content) | % by mass | — | — | — | — | — | — | — | — |
| | Carbon fibers | % by mass | — | — | — | — | — | — | — | — |
| | Mass ratio (guanidine sulfamate/guanidine phosphate) | — | 10/90 | 10/90 | 10/90 | 10/90 | 10/90 | 10/90 | 15/85 | 20/80 |
| Basis weight | | g/m$^2$ | 108 | 108 | 108 | 104 | 108 | 114 | 108 | 108 |
| Flame retardancy of flame retardant paper (UL94 V-0) | | — | Pass | Pass | Pass | Pass | Pass | Pass | Pass | Pass |
| Flame retardancy of stuck product (UL94 HBF) | | — | Pass | Pass | Pass | Pass | Pass | Pass | Pass | Pass |
| Tearability | | Times | 3 | 7 | 11 | >20 | 5 | 3 | 6 | 6 |
| Corrosiveness | | — | A | A | A | A | A | A | A | A |
| Complex permittivity | | — | B | B | B | B | B | B | B | B |

TABLE 2

| | | Unit | Example 9 | Example 10 | Example 11 | Example 12 | Example 13 | Example 14 | Example 15 |
|---|---|---|---|---|---|---|---|---|---|
| Treatment | Pulp | % by mass | 20 | 20 | 20 | 20 | 19 | 19 | 18 |
| | Aluminum hydroxide | % by mass | 60 | 60 | 59.5 | 59 | 59 | 58 | 57 |
| | Glass fibers | % by mass | 15 | 15 | 15 | 15 | 15 | 14 | 14 |
| | Flame retardant agent | % by mass | 5 | 5 | 5 | 5 | 5 | 5 | 5 |
| | Guanidine phosphate (content) | % by mass | 3.75 | 2.5 | 4.5 | 4.5 | 4.5 | 4.5 | 4.5 |
| | Guanidine sulfamate (content) | % by mass | 1.25 | 2.5 | 0.5 | 0.5 | 0.5 | 0.5 | 0.5 |
| | Polyborate (content) | % by mass | — | — | — | — | — | — | — |
| | Carbon fibers | % by mass | — | — | 0.5 | 1.0 | 2.0 | 4.0 | 6.0 |

TABLE 2-continued

| | Unit | Example 9 | Example 10 | Example 11 | Example 12 | Example 13 | Example 14 | Example 15 |
|---|---|---|---|---|---|---|---|---|
| Mass ratio (guanidine sulfamate/ guanidine phosphate) | — | 25/75 | 50/50 | 10/90 | 10/90 | 10/90 | 10/90 | 10/90 |
| Basis weight | $g/m^2$ | 108 | 108 | 108 | 108 | 108 | 108 | 108 |
| Flame retardancy of flame retardant paper (UL94 V-0) | — | Pass | Pass | Pass | Pass | Pass | Pass | Pass |
| Flame retardancy of stuck product (UL94 HBF) | — | Pass | Pass | Pass | Pass | Pass | Pass | Pass |
| Tearability | Times | 7 | 18 | 7 | 7 | 7 | 7 | 7 |
| Corrosiveness | — | A | B | A | A | A | A | A |
| Complex permittivity | | B | B | A | A | A | A | A |

Comparative Example 1

The method of Example 1 was performed in the same manner except that the pulp and the aluminum hydroxide of Example 1 were 5% by mass and 75% by mass, respectively. However, the production was not stable, and the flame retardant paper of Comparative Example 1 was not obtained. The results of the evaluation and the like are shown in Table 3.

Comparative Example 2

A flame retardant paper having a basis weight of 108 $g/m^2$ of Comparative Example 2 was obtained in the same manner as in Example 1 except that the pulp, the aluminum hydroxide, and the glass fibers of Example 1 were 40% by mass, 35% by mass, and 20% by mass, respectively.

The resulting flame retardant paper was evaluated. The results are shown in Table 3. The burning rate of the flame retardant paper was fast and failed UL94 V-0. The burning rate of the member stuck on expanded polystyrene was also fast and failed UL94 HBF. The tearability was 13 times. Thus, the above flame retardant paper showed excellent tearability. The corrosiveness by the flame retardant paper to the metal was not observed. The performance of the radio wave absorption was not exhibited.

Comparative Example 3

A flame retardant paper having a basis weight of 100 $g/m^2$ of Comparative Example 3 was obtained in the same manner as in Example 4 except that the aluminum hydroxide and the flame retardant agent of Example 4 were 65% by mass and 0% by mass, respectively.

The resulting flame retardant paper was evaluated. The results are shown in Table 3. The burning rate of the flame retardant paper was slow and passed UL94 V-0. On the other hand, the burning rate of the member stuck on expanded polystyrene was fast and failed UL94 HBF. The tearability was 20 times or more. Thus, the above flame retardant paper showed excellent tearability. The corrosiveness by the flame retardant paper to the metal was not observed. The performance of the radio wave absorption was not exhibited.

Comparative Example 4

A flame retardant paper having a basis weight of 115 $g/m^2$ of Comparative Example 4 was obtained in the same manner as in Example 6 except that the aluminum hydroxide and the flame retardant agent of Example 6 were 58% by mass and 11% by mass, respectively.

The resulting flame retardant paper was evaluated. The results are shown in Table 3. The burning rate of the flame retardant paper was slow, and passed UL94 V-0. On the other hand, the burning rate of the member stuck on expanded polystyrene was fast, and failed UL94 HBF. The tearability was 2 times. Thus, the above flame retardant paper showed poor tearability. The corrosiveness by the flame retardant paper to the metal was not observed. The performance of the radio wave absorption was not exhibited.

Comparative Example 5

A flame retardant paper having a basis weight of 108 $g/m^2$ of Comparative Example 5 was obtained in the same manner as in Example 2 except the flame retardant agent containing guanidine phosphate and guanidine sulfamate of Example 2 was only guanidine phosphate.

The resulting flame retardant paper was evaluated. The results are shown in Table 3. The burning rate of the flame retardant paper was slow, and passed UL94 V-0. On the other hand, the burning rate of the member stuck on expanded polystyrene was fast, and failed UL94 HBF. The tearability was 4 times. Thus, the above flame retardant paper showed poor tearability. The corrosiveness by the flame retardant paper to the metal was not observed. The performance of the radio wave absorption was not exhibited.

Comparative Example 6

A flame retardant paper having a basis weight of 114 $g/m^2$ of Comparative Example 6 was obtained in the same manner as in Example 6 except the flame retardant agent containing guanidine phosphate and guanidine sulfamate of Example 6 was a polyborate (product name "SOUFA" (trade name) manufactured by Soufa Inc.).

The resulting flame retardant paper was evaluated. The results are shown in Table 3. The burning rate of the flame retardant paper was slow and passed UL94 V-0. The burning rate of the member stuck on expanded polystyrene was also slow and passed UL94 HBF. The tearability was 1 time. Thus, the above flame retardant paper showed poor tearability. The corrosiveness by the flame retardant paper to the metal was not observed. The performance of the radio wave absorption was not exhibited.

TABLE 3

| | | Unit | Comparative Example 1 | Comparative Example 2 | Comparative Example 3 | Comparative Example 4 | Comparative Example 5 | Comparative Example 6 |
|---|---|---|---|---|---|---|---|---|
| Treatment | Pulp (content) | % by mass | 5 | 40 | 20 | 18 | 20 | 18 |
| | Aluminum hydroxide (content) | % by mass | 75 | 35 | 65 | 58 | 60 | 59 |
| | Glass fibers (content) | % by mass | 15 | 20 | 15 | 13 | 15 | 13 |
| | Reagent that imparts flame retardancy (total content) | % by mass | 5 | 5 | 0 | 11 | 5 | 10 |
| | Guanidine phosphate (content) | % by mass | 4.5 | 4.5 | — | 4.5 | 5 | — |
| | Guanidine sulfamate (content) | % by mass | 0.5 | 0.5 | — | 0.5 | — | — |
| | Polyborate (content) | % by mass | — | — | — | — | — | 10 |
| | Carbon fibers | % by mass | — | — | — | — | — | — |
| | Mass ratio (guanidine sulfamate/guanidine phosphate) | — | 10/90 | 10/90 | — | 10/90 | — | — |
| Basis weight | | $g/m^2$ | — | 108 | 100 | 115 | 108 | 114 |
| Flame retardancy of flame retardant paper (UL94 V-0) | | — | — | Fail | Pass | Pass | Pass | Pass |
| Flame retardancy of stuck product (UL94 HBF) | | — | — | Fail | Fail | Fail | Fail | Pass |
| Tearability | | Times | — | 13 | >20 | 2 | 4 | 1 |
| Corrosiveness | | — | — | A | A | A | A | A |
| Complex permittivity | | — | B | B | B | B | B | B |

In Examples 1 to 10, flame retardant papers having excellent flame retardancy for the flame retardant papers as well as for the members obtained by sticking the flame retardant papers on expanded polystyrene, excellent tearability, and excellent corrosiveness to metal could be obtained. In Examples 11 to 15, in addition to the above characteristics, flame retardant papers excellent in the performance of radio wave absorption could be obtained.

On the other hand, in Comparative Example 1, stable production was not possible. In Comparative Example 2, although the tearability was excellent, the flame retardancy of the flame retardant paper and the stuck product was poor. Comparative Example 3 showed excellent tearability and flame retardancy for the flame retardant paper, but showed poor flame retardancy for the stuck product. In Comparative Examples 4 and 5, the flame retardancy of the flame retardant papers was excellent, but the stuck products showed poor flame retardancy and tearability. In Comparative Example 6, although the flame retardant paper and the stuck product were excellent in flame retardancy, they showed poor tearability.

The invention claimed is:

1. A flame retardant paper comprising pulp, aluminum hydroxide, guanidine phosphate, carbon fibers and guanidine sulfamate, wherein the content of said pulp is 10 to 35% by mass and the content of said aluminum hydroxide is 40 to 70% by mass, and the total content of said guanidine phosphate and said guanidine sulfamate is 0.1 to 10% by mass based on the contents of said flame retardant paper.

2. The flame retardant paper according to claim 1, wherein the content of said pulp is 20 to 35% by mass, and the total content of said guanidine phosphate and said guanidine sulfamate is 0.3 to 9% by mass.

3. The flame retardant paper according to claim 1, wherein a mass ratio of said guanidine sulfamate to said guanidine phosphate (guanidine sulfamate/guanidine phosphate) is 5/95 or more and 30/70 or less.

4. A radio wave absorbing sheet comprising the flame retardant paper according to claim 1.

* * * * *